United States Patent [19]

Hoff

[11] Patent Number: 4,738,433

[45] Date of Patent: Apr. 19, 1988

[54] POST PULLER

[76] Inventor: Haral Hoff, Rte. 2, Box 50, Williston, N. Dak. 58801

[21] Appl. No.: 839,263

[22] Filed: Mar. 13, 1986

[51] Int. Cl.[4] ..... E21B 19/00

[52] U.S. Cl. ..... 254/30; 254/DIG. 1

[58] Field of Search ..... 254/29 R, 30–31, 254/129–132, 120, DIG. 1

[56] References Cited

U.S. PATENT DOCUMENTS

| | | | |
|---|---|---|---|
| 580,737 | 4/1897 | Smith | 254/31 |
| 826,124 | 7/1906 | Soseman | 254/DIG. 1 |
| 1,185,627 | 6/1916 | Brown | 254/31 |
| 1,901,915 | 3/1933 | Loughridge | 254/126 |
| 1,916,463 | 7/1933 | Carrel | 254/132 |
| 2,099,592 | 11/1937 | Barton | 254/30 |
| 2,777,726 | 1/1957 | Lundgren . | |
| 2,826,392 | 3/1958 | Kohorst . | |
| 2,994,510 | 8/1961 | Michalak . | |
| 3,155,372 | 11/1964 | Brown . | |
| 3,317,185 | 5/1967 | Burk . | |
| 3,779,516 | 12/1973 | King . | |
| 4,161,310 | 7/1979 | Parker . | |
| 4,304,394 | 12/1981 | O'Hara et al. | 254/DIG. 1 |
| 4,327,534 | 5/1982 | Mastalski et al. | 254/30 |

FOREIGN PATENT DOCUMENTS

| | | | |
|---|---|---|---|
| 188491 | 3/1956 | Austria | 254/30 |

*Primary Examiner*—Robert C. Watson

*Attorney, Agent, or Firm*—Zarley, McKee, Thomte, Voorhees & Sease

[57] ABSTRACT

A fence post puller comprising a vertically disposed support post having a base plate mounted on the lower end thereof by means of a swivel or knuckle joint connection. An elongated handle is pivotally connected to the upper end of the support post and has a yoke pivotally secured to one end thereof which is adapted to embrace and engage the post during upward movement of the yoke.

2 Claims, 3 Drawing Sheets

POST PULLER

BACKGROUND OF THE INVENTION

Many types of post pullers have been previously provided for pulling steel fence posts from the ground. For example, in U.S. Pat. No. 4,161,310, a vertically disposed support member having a base plate rigidly secured to the lower end thereof supports a handle operated gripping means. The device of U.S. Pat. No. 4,161,310, as well as other prior art devices, is difficult to use due to the fact that the ground adjacent the fence post is very often irregular and the engagement of the rigidly mounted base plate with the ground results in the support member thereof not being properly positioned relative to the post to efficiently remove the post from the ground. Further, the prior art devices are not convenient to use and are not efficient.

Therefore, it is a principal object of the invention to provide an improved post puller.

A further object of the invention is to provide a post puller including a base plate or foot portion having a swivel connection connecting it to a vertically disposed support.

Yet another object of the invention is to provide a post puller including an improved post gripping means.

A further object of the invention is to provide an improved post puller including a handle which is designed to achieve the utmost efficiency in the post pulling operation.

Still another object of the invention is to provide a post puller including a removable pin on the post gripping apparatus so that the post gripping apparatus may be quickly and easily positioned around the post to be pulled.

Yet another object of the invention is to provide a post puller which is economical of manufacture, durable in use and refined in appearance.

These and other objects will be apparent to those skilled in the art.

SUMMARY OF THE INVENTION

Figures 1, 8:
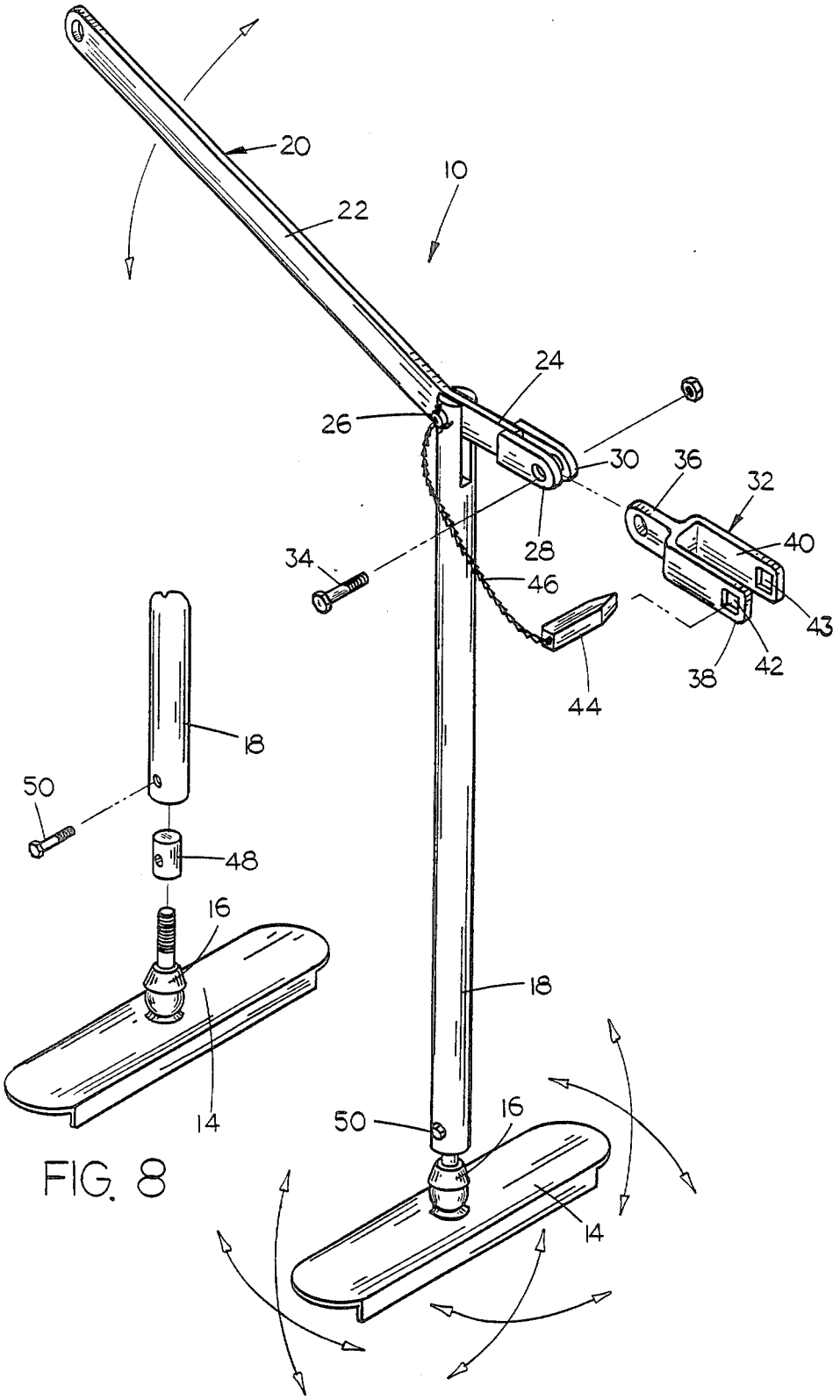
FIG. 1 is a perspective view of the post puller of this invention.
FIG. 8 is a partial exploded perspective view of the swivel joint connection.
Figure 2:
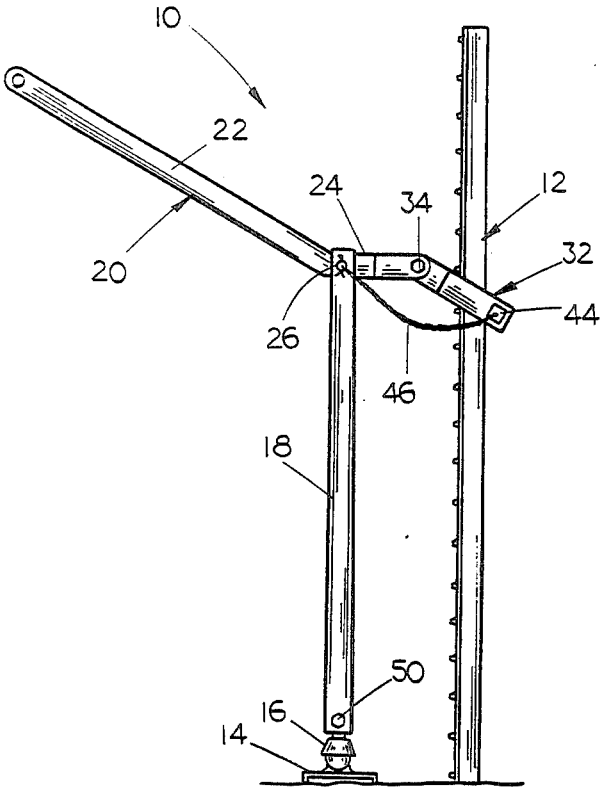
FIG. 2 is a side view illustrating the post puller positioned adjacent the post with the post puller in the post gripping position.

The post puller of this invention comprises an elongated handle which is pivotally mounted on the upper end of a vertically disposed support post. The lower end of the support post has a swivel connection mounted thereon which is connected to a base plate or foot portion. The handle comprises handle portions which are angularly disposed with respect to each other so that an extremely efficient post pulling operation is provided. A post gripping apparatus is pivotally mounted to the handle and includes a yoke portion which may be extended around the post. A square pin is inserted through the yoke. As the handle is moved downwardly, the square pin and the yoke engage and grip the post so that the post is pulled upwardly from the ground. When the handle is moved from its lowermost position to its uppermost position, the yoke disengages from the post and moves downwardly therefrom for the next pulling stroke. The swivel connection between the support post and the base plate permits the post puller to be properly positioned adjacent the post even if the ground around the post is irregular or is sloped.

DESCRIPTION OF THE PREFERRED EMBODIMENT

The post puller of this invention is referred to generally by the reference numeral 10 while the reference numeral 12 refers to a steel fence post commonly referred to as being of the "T" type. Post puller 10 includes a base plate or foot portion 14 having a swivel or knuckle joint connection 16 secured thereto. The lower end of a support post 18 is secured to the upper end of the joint 16 and extends upwardly therefrom.

The numeral 20 refers to an elongated handle comprising handle portions 22 and 24 which are angularly disposed with respect to each other as illustrated in the drawing. Handle 20 is pivotally connected to the upper end of the support post 18 by means of the bolt assembly 26. As seen in the drawings, handle 20 is pivotally connected to the support post 18 at the juncture of the handle portions 22 and 24.

A pair of spaced-apart plates 28 and 30 are welded to the end of handle portion 24 and have a yoke 32 pivotally secured thereto by means of bolt assembly 34. Yoke 32 includes a base portion 36 having a pair of spaced-apart yoke members 38 and 40 extending therefrom. Yokes 38 and 40 are provided with square openings 42 and 43 formed therein respectively adapted to receive square pin 44 therein as will be described hereinafter. Pin 44 has a chain 46 secured to one end thereof which extends to the support post.

When it is desired to pull or remove a post 12 from the ground, pin 44 is first removed from the yoke members and the post puller 10 is positioned adjacent the post 12. The swivel or knuckle joint connection between the base plate 14 and the post 12 enables the post puller to be properly positioned relative to the post even if the ground is irregular adjacent the post. The swivel connection between the base plate and the post enables the post 12 to be vertically disposed so as to be parallel with the longitudinal axis of the post 12 so that the most efficient pulling operation will be achieved.

Figure 3:
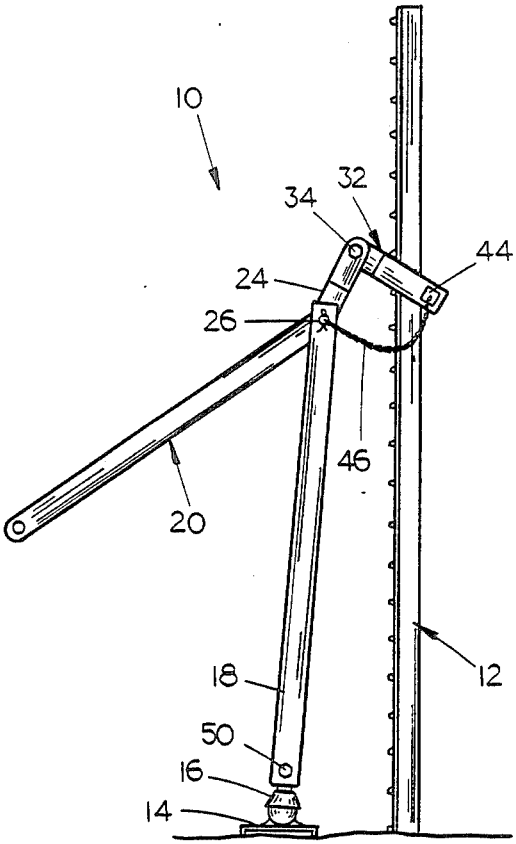
FIG. 3 is a view similar to FIG. 2 except that the post has been raised upwardly from the position of FIG. 2.
Figure 5:
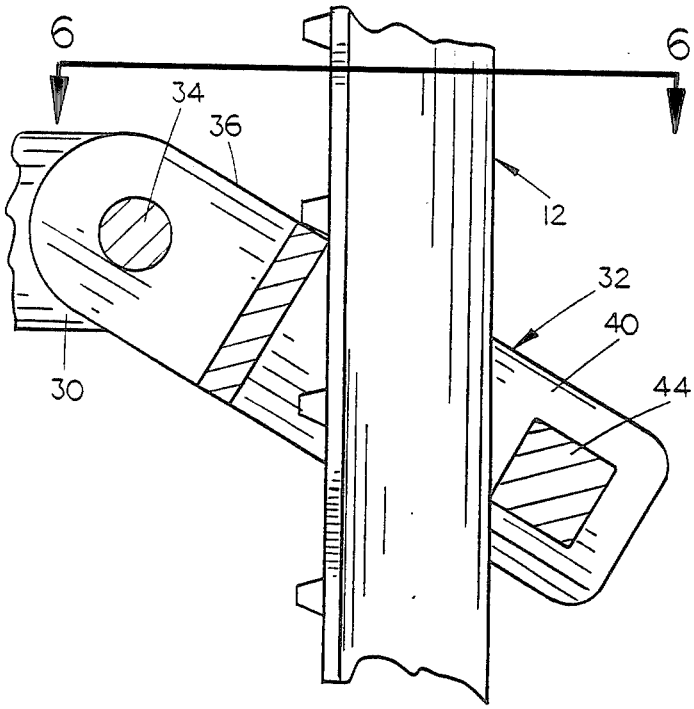
FIG. 5 is a sectional view illustrating the relationship of the post gripper and the post.
Figure 6:
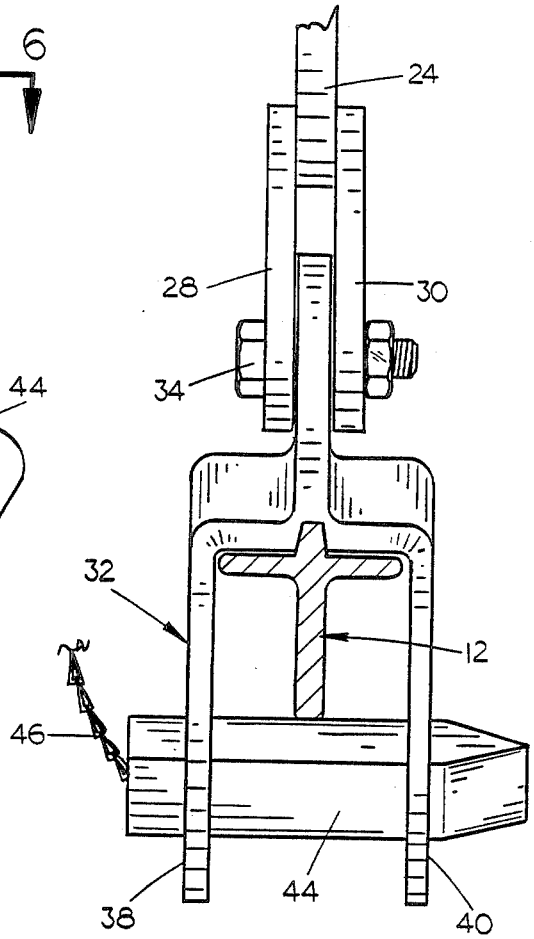
FIG. 6 is a sectional view as seen on lines 6—6 of FIG. 5.

As stated, pin 44 is removed from the yoke members 38 and 40 and the yoke members 38 and 40 are positioned on opposite sides of the post as illustrated in the drawings. Pin 44 is then positioned in the openings 42 and 43 of the yoke members 38 and 40 and the handle portion 22 is raised to its uppermost position. Handle portion 22 is then moved downwardly which causes the yoke 32 and the pin 44 to engage and grip opposite sides of the post as illustrated in FIGS. 5 and 6 to pull the same upwardly as the handle portion 22 is moved from its uppermost position to its lowermost position as seen in FIG. 3. For each downward stroke of the handle portion 22, the post 12 is moved upwardly approximately eight inches.

Figure 4:
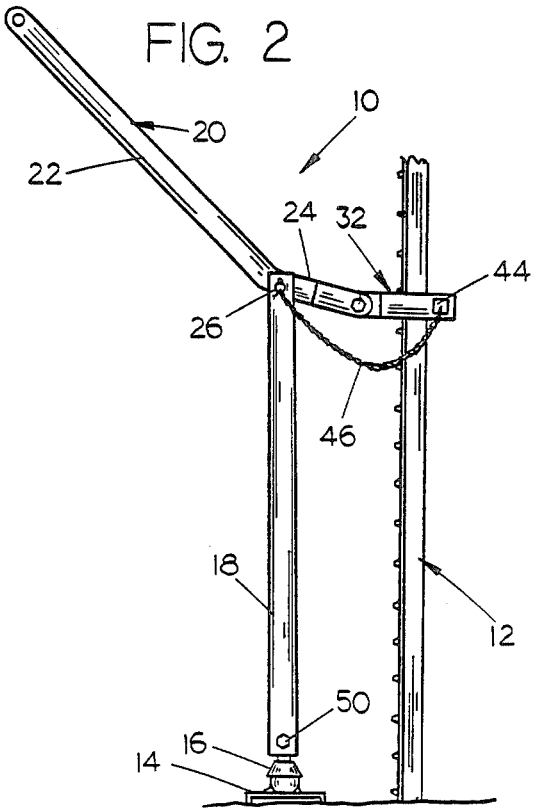
FIG. 4 is a view similar to FIGS. 2 and 3 except that the handle of the post puller has been moved to its upper position.
Figure 7:
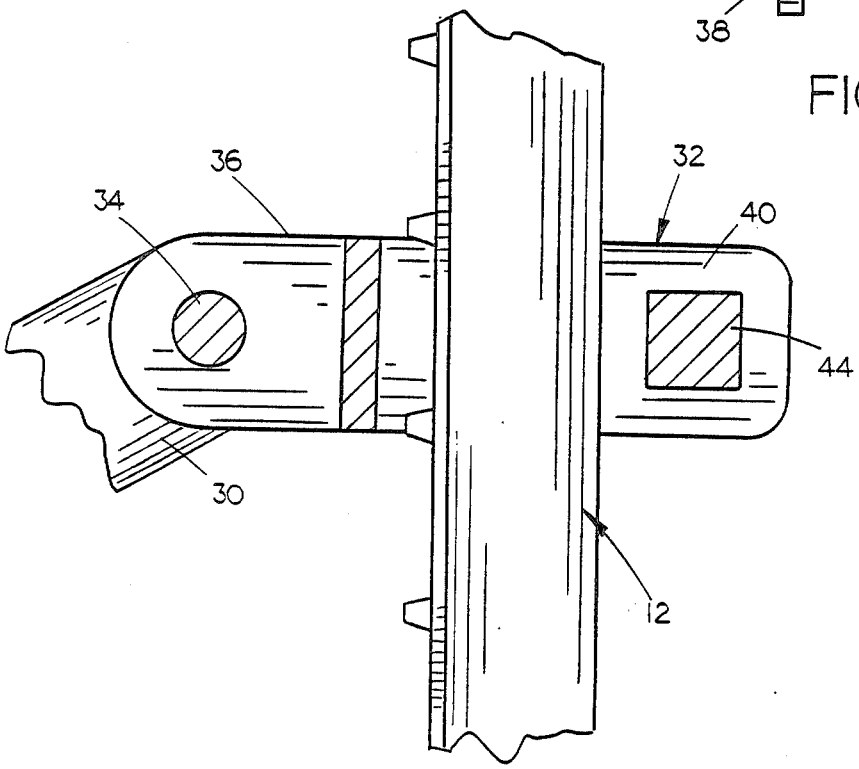
FIG. 7 is a sectional view similar to FIG. 5 except that the post gripper is illustrated in its non-engaging position.

When handle portion 22 has reached its lowermost position, handle portion 22 is then moved to its uppermost position as seen in FIG. 4. Movement of the handle portion 22 to its uppermost position causes the yoke 32 and the pin 44 to disengage from the post as seen in FIG. 7 so that the yoke and the pin may be moved downwardly relative to the post 12 in an efficient manner. The operation is repeated until the post has been removed from the ground.

The fact that the pin 44 is removably mounted in the yoke 32 permits the post puller to be positioned quickly and easily adjacent the post without any component of the post puller being required to be extended over the top of the post. Further, the swivel or knuckle joint connection between the support post 12 and the base plate 14 ensures that the support post 18 will be properly positioned as previously discussed. Thus it can be seen that the invention accomplishes at least all of its stated objectives.

I claim:

1. A fence post puller, comprising:

a foot portion having a generally planar base and two depending edges in engagement with the ground, said edges disposed on opposite ends of said base, said foot portion adjacent the post to be pulled, an elongated support member having upper and lower ends, said support member having a swivel connection connecting its lower end to the base of said foot portion, and extending upwardly therefrom, an elongated handle having first and second ends, said handle being pivotally secured, inwardly and proximal to said second end, to the upper end of said support member, said first end of said handle being movable between upper and lower positions, said handle including a first handle portion extending from the pivotal connection with said support member towards said first end, and a second handle portion extending from the pivotal connection with said support member towards said second end, said first and second handle portions being angularly disposed within a vertical plane with respect to each other, said first and second handle portions being angularly disposed such that said second handle portion is substantially horizontally disposed when said first end of said handle is in its upper position, a yoke means pivotally secured to said second end of said handle and comprising a generally T-shaped base portion having a pair of spaced-apart yoke members extending therefrom adapted to loosely embrace the post to be pulled, said yoke members extending perpendicularly to the head of said T-shaped base portion, and the base leg of the T-shaped base portion being pivotally connected to said handle, and a pin removably secured to and extending between said yoke members for engagement with one side of said post when said first end of said handle is moved towards its lower position, to pull said post upwardly relative to the ground, said pin having a generally square cross section.

2. A fence post puller, comprising:

a foot portion having a generally planar base for engaging ground adjacent the post to be pulled, an elongated support member having upper and lower ends, a swivel connection connecting the lower end of said support member to said foot portion and extending upwardly therefrom, an elongated handle having first and second ends, said handle being pivotally secured, inwardly and proximal to said second end, to the upper end of said support member, said first end of said handle being movable between upper and lower positions, said handle including a first handle portion extending from the pivotal connection with said support member towards said first end, and a second handle portion extending from the pivotal connection with said support member towards said second end, said first and second handle portions being angularly disposed within a vertical plane with respect to each other, said first and second handle portions being angularly disposed such that said second handle portion is substantially horizontally disposed when said first end of said handle is in its upper position, a yoke means pivotally secured to said second end of said handle and comprising a generally T-shaped base portion having a pair of spaced-apart yoke members extending therefrom adapted to loosely embrace the post to be pulled, said yoke member extending perpendicularly to the head of said T-shaped base portion, the base leg of the T-shaped base portion being pivotally connected to said handle, and a pin removably secured to and extending between said yoke members for engagement with one side of said post when said first end of said handle is moved towards its lower position, to pull said post upwardly relative to the ground, said pin having a generally square cross section.

* * * * *